US007028808B2

(12) United States Patent
Zeaman

(10) Patent No.: US 7,028,808 B2
(45) Date of Patent: Apr. 18, 2006

(54) DEVICE AND METHOD FOR ASSISTING IN THE MOVEMENT OF A LADDER

(76) Inventor: Robby Zeaman, 203 Carrington Ct., Warwick, PA (US) 18974

( * ) Notice: Subject to any disclaimer, the term of this patent is extended or adjusted under 35 U.S.C. 154(b) by 0 days.

(21) Appl. No.: 10/621,422

(22) Filed: Jul. 18, 2003

(65) Prior Publication Data

US 2005/0011702 A1 Jan. 20, 2005

(51) Int. Cl.
*E04G 5/02* (2006.01)

(52) U.S. Cl. ..... 182/108; 182/107

(58) Field of Classification Search ..... 16/42 R, 16/42 T, 18 CG; 280/845, 28.17; 248/188.9, 248/346.11; 182/108, 107, 109, 214, 129, 182/110, 111
See application file for complete search history.

(56) References Cited

U.S. PATENT DOCUMENTS 1,382,833 A * 6/1921 Hurd ..... 182/108
2,273,124 A * 2/1942 McDaniels ..... 182/108
2,717,410 A * 9/1955 Holloman ..... 16/29
2,904,128 A * 9/1959 Boham et al. ..... 182/108
3,062,319 A * 11/1962 Wright ..... 182/108
3,446,309 A * 5/1969 Davis et al. ..... 182/108
3,623,184 A * 11/1971 Mazur ..... 16/42 R
5,141,076 A * 8/1992 Joyce et al. ..... 182/108
5,224,506 A * 7/1993 Allen et al. ..... 16/42 T
5,417,302 A * 5/1995 McElfresh ..... 182/108
5,427,342 A * 6/1995 Gagnon ..... 248/188.9
5,791,435 A * 8/1998 Garnett ..... 182/107
5,802,669 A * 9/1998 Wurdack ..... 16/42 R
6,499,563 B1 * 12/2002 Bremick ..... 182/108
6,761,340 B1 * 7/2004 Shaw ..... 248/188.9

* cited by examiner

*Primary Examiner*—Hugh B. Thompson, II
(74) *Attorney, Agent, or Firm*—Lamorte & Associates

(57) ABSTRACT

A device and method for improving the mobility of a ladder. The device includes slide pads that attach to the bottom ends of a ladder's rails. In this manner, the slide pads are interposed between the bottom of the ladder rails and the ground when the ladder is erected. The bottom surface of the slide pads have a lower coefficient of friction than do the bottom ends of the ladder rails. Accordingly, the presence of the slide pads at the bottom of the ladder rails makes the ladder rails easier to slide over the ground.

8 Claims, 5 Drawing Sheets

DEVICE AND METHOD FOR ASSISTING IN THE MOVEMENT OF A LADDER

BACKGROUND OF THE INVENTION

1. Field of the Invention

The present invention relates to devices that are placed under heavy objects to assist in the pulling of those heavy objects along the floor from one position to another.

2. Prior Art Statement

Many objects in modern life are either too heavy or too cumbersome to be lifted and moved by the average person. However, it is often desirable to move such objects. For example, many tables and sofas are too large and heavy to be lifted by a person. However, many people periodically move such pieces of furniture to either redecorate or to clean the area below and behind such furniture.

To address this problem, slide pads have been developed. Slide pads are plastic pads that have very smooth base surfaces. The slide pads are placed under the legs of a sofa, chair or other heavy piece of furniture. When a person wants to move the heavy piece of furniture, that person merely pulls the furniture along the floor. The presence of the slide pads under the legs of the furniture prevents the legs of the furniture from scratching the floor or binding on carpeting. Furthermore, the smooth base of the glide pads has a low coefficient of friction. Consequently, the presence of the slide pads under the furniture greatly reduces the amount of effort needed to slide the furniture from point-to-point along the floor.

Prior art slide pads are most commonly saucer shaped. They are placed under the leg of a piece of furniture and remain in place due to the friction between the furniture and the top of the slide pad as the slide pad bears the weight of the furniture. Nothing physically attaches the slide pads to the furniture they support.

Painters, cleaners, maintenance personnel and the like often use A-frame stepladders to reach high points in a room. In office buildings, it is not unusual for a cleaner or maintenance worker to move a stepladder from place-to-place throughout an entire working shift. As is often the case, printers, cleaners and maintenance personal keep buckets, brushes and tools at the top of the ladder so that these items can be easily accessed by a person standing near the top of the ladder. Each time the ladder must be moved, a person must carry the equipment down from the top of the ladder, lift the ladder, carry it to its new position and carry the equipment back to the top of the ladder. Accordingly, it is not uncommon for a painter or a cleaner to spend just as much time moving a ladder from point-to-point as they spend painting or cleaning atop the ladder.

Due to the elongated structure of A-frame ladders, they typically do not slide well along floors. Rather, when pushed or pulled, some of the ladder legs inevitably stick to the floor while others move. This causes the ladder to shudder and jerk as it is pushed or pulled along a surface. Such a moving dynamic makes it impractical to keep a bucket or tools on the ladder as the ladder is being moved, since the jerky movement of the ladder will cause the contents of the bucket to splash or cause tools to fall. A person, therefore, has little choice but to remove all equipment from the ladder and physically carry the ladder from point-to-point.

In the prior art, devices have been made that are intended to improve the ease at which a ladder can be moved. Many such devices include the use of wheeled stands, wherein the ladders are set upon the wheeled stands. The wheeled stands are then rolled from point-to-point, thereby moving the ladder between those points. The use of wheeled stands is cumbersome and expensive. It also detracts from the safety of the ladder in that the ladder is now supported by wheels and can inadvertently move out from a person leaning on the ladder.

Traditional slide pads, such as those used for furniture do not work well on ladders. First, ladders are often lifted. Since traditional slide pads are not attached to the legs of a ladder, the slide pads detach from the ladder every time it is lifted. Furthermore, ladders are moved after a person climbs down from the ladder. As such, if traditional slide pads are used, only the weight of the ladder presses against the top of the slide pads. Ladders are typically very light in weight. The frictional force created between the legs of the ladder and traditional slide pads is often insufficient to keep traditional slide pads in place as the ladder is pulled across the floor. The slide pads, therefore, slide out from under the ladder and the ladder again must be carried from point-to-point.

A need therefore exists for an improved slide pad device that can be physically attached to the feet of a ladder, thereby making the ladder easy to slide from point-to-point along a floor. This need is met by the present invention as described and claimed below.

SUMMARY OF THE INVENTION

The present invention is a device and method for improving the mobility of a ladder. The device includes slide pads that attach to the bottom ends of a ladder's rails. In this manner, the slide pads are interposed between the bottom of the ladder rails and the ground when the ladder is erected. The bottom surface of the slide pads have a lower coefficient of friction than do the bottom ends of the ladder rails. Accordingly, the presence of the slide pads at the bottom of the ladder rails makes the ladder rails easier to slide over the ground.

If the ladder is a stepladder, the stepladder will have support rails as well as ladder rails. The slide pads are placed solely under the ladder rails. The slide pads present a lower coefficient of friction against the ground than do the support rails. As such, when the ladder is stood upon, the contact of the support rails against the ground prevents the stepladder from inadvertently moving. When the stepladder is moved, only the support rails need be lifted and the ladder rails can be dragged across the ground on the slide pads, thereby moving the ladder in a smooth, efficient manner.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention device can be used to help move any object having legs, such as tables, chairs and the like, the present invention is particularly well suited for use on A-frame stepladders. Accordingly, by way of example, the present invention device will be described in use on an A-frame stepladder in order to present the best mode contemplated for the invention.

Figure 1:
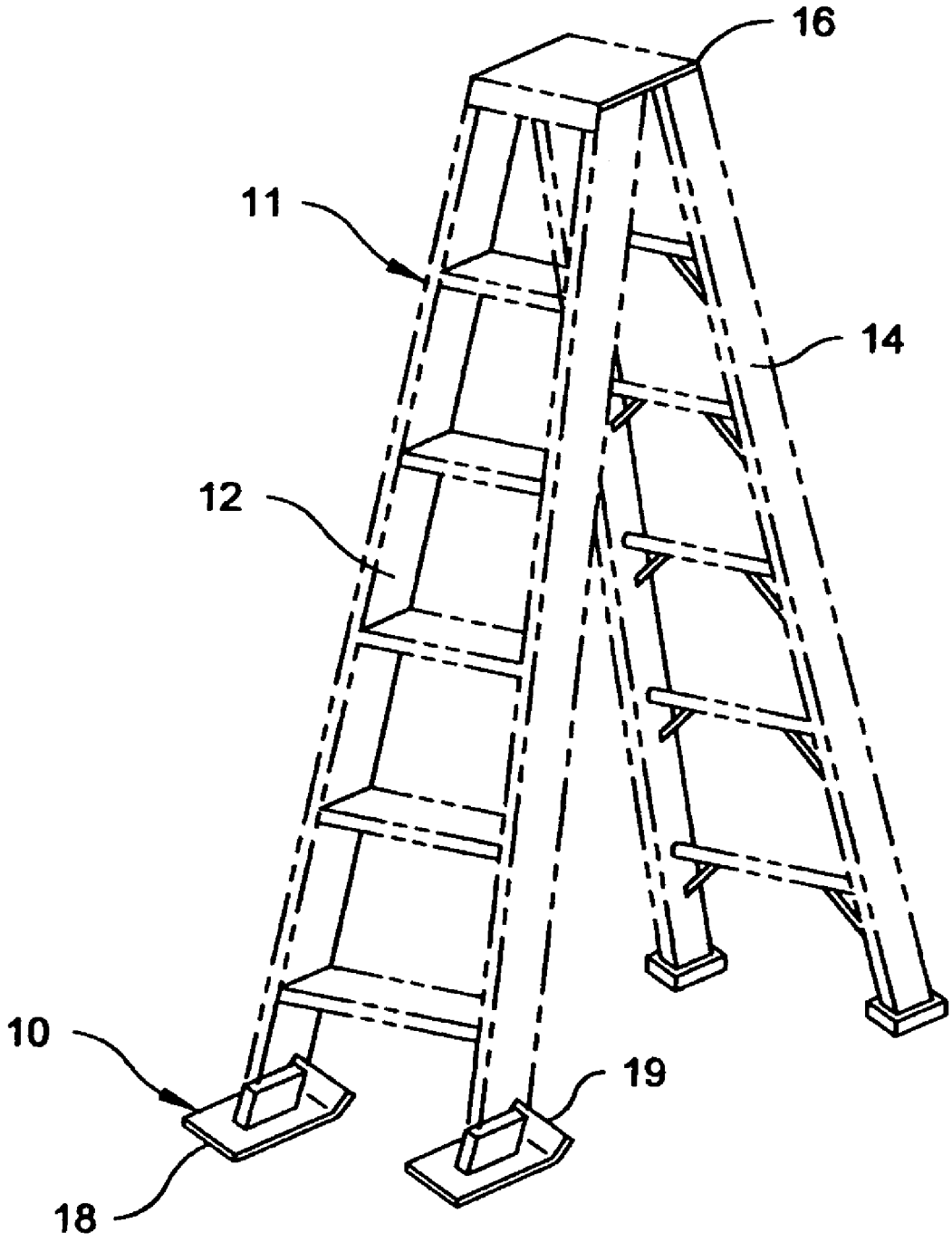
FIG. 1 is a perspective view of an exemplary embodiment of a stepladder in accordance with the present invention.

Referring to FIG. 1, an exemplary embodiment of the present invention slide pad device 10 is shown connected to the ladder rails 12 of an A-frame stepladder 11. An A-frame stepladder 11 has ladder rails 12 and support rails 14 that attach to a common top platform 16. The ladder rails 12 have bottom ends that typically rest on the ground. The bottom ends of the ladder rails 12 typically terminate with a pad or other non-slip configuration to help prevent the ladder rails 12 from inadvertently moving along the ground. The support rails 14 of the stepladder 11 also have bottom ends that rest on the ground. As such, when the stepladder 11 is in use, the stepladder 11 is supported on the ground at four points.

The present invention is a slide pad device 10 that is specifically designed to engage the bottom ends of the ladder rails 12. Each slide pad device 10 has a smooth enlarged base 18 that can slide across carpeting and other types of flooring with far less resistance than the bottoms of the ladder rails themselves. Each slide pad device 10 attaches to the bottom end of a ladder rail 12. Accordingly, when the stepladder 11 is lifted and moved, the slide pad devices 10 remain in place.

As can be seen from FIG. 1, the slide pad devices 10 are placed only on the ladder rails 12 of the stepladder 11. No slide pad devices are placed on the bottom of the support rails 14. Accordingly, when the stepladder 11 is erected, the bottoms of the support rails 14 directly touch the floor, while the bottoms of the ladder rails 12 rest upon the slide pad devices 10. The contact of the support rails 14 with the floor provides enough friction that the stepladder 11 will not inadvertently move when a person is standing on the stepladder 11. However, to move the stepladder 11 along the floor, a person must merely lift the support rails 14 off the floor. The ladder rails 12 can remain on the floor, wherein the slide pad devices 10 are interposed between the ladder rails 12 and the floor. By lifting the support rails 14 off the floor and either pushing or pulling the stepladder 11, each slide pad device 10 will begin to slide along the floor with little effort. As a result, the stepladder 11 will move smoothly from one point to another. The stepladder 11 can be moved so smoothly, that equipment, such as tools, buckets and the like can be left on the stepladder 11. The stepladder 11 can then be easily and smoothly moved in a manner that does not cause splashing in the buckets or displacement of the tools retained on the stepladder 11.

Figure 2:
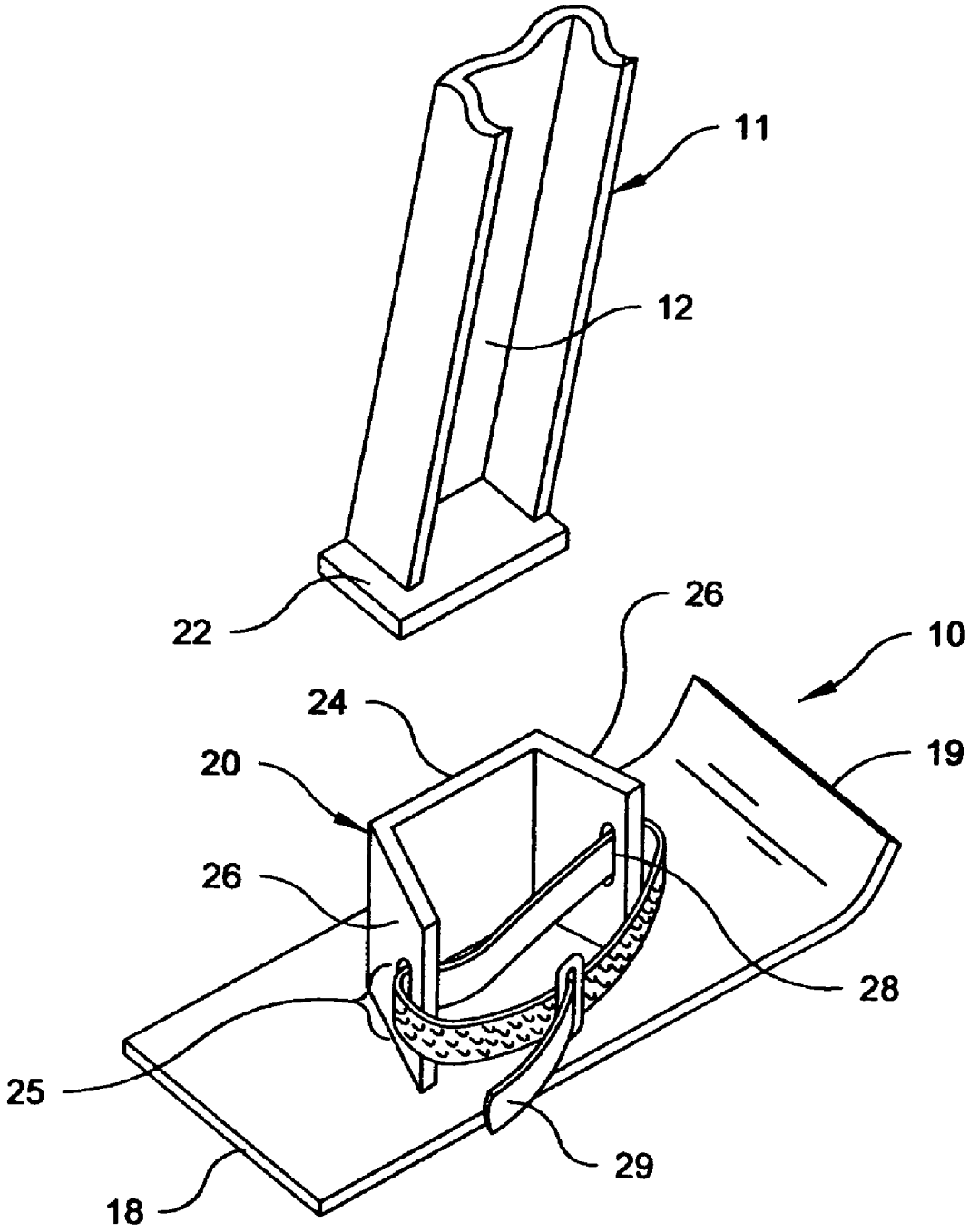
FIG. 2 is a perspective view of a first embodiment of a slide pad device.

Referring now to FIG. 2, the structure of an exemplary embodiment of the slide pad device 10 is shown. In this embodiment, there is an enlarged base 18. The slide pad base 18 has a smooth bottom surface. One edge 19 of the slide pad base 18 curves upwardly, forming a sled structure. The curved edge 19 is mounted in the direction of slide travel, as will later be explained. The smoothness of the slide pad base 18 causes the slide pad base 18 to have a low coefficient of friction. As such, the slide pad base 18 can be easily moved across different types of floor coverings, such as carpet, hardwood and tile. The curved edge 19 of the slide pad base 18 helps prevent the slide pad base 18 from binding on carpeting or sticking on edges that may be present on the floor when the slide pad base 18 travels in the direction of the curved edge 19.

A receptacle structure 20 extends upwardly from the center of the top surface of the slide pad base 18. The receptacle structure 20 serves two purposes. First, the receptacle structure 20 receives the bottom of a ladder rail 12 and centers the ladder rail 12 on the slide pad base 18. This ensures that the weight borne by the ladder rail 12 is centrally supported by the slide pad base 18. The second purpose of the receptacle structure 20 is to mechanically engage the ladder rail 12, thereby connecting the slide pad base 18 to the ladder rail 12. In this manner, should the stepladder 11 ever be lifted or otherwise moved, the slide pad device 10 will not fall way from the ladder rail 12.

Ladders in general, and stepladders in particular, come in a wide variety of sizes. Typically, different ladder rails 12 are used for different sized stepladders 11. The larger the stepladder 11 is, the more strength is needed and the bigger the ladder rail 12 is manufactured. For most stepladders 11, the ladder rail 12 used in the construction of that stepladder 11 is between 1½ inches wide and four inches long. The footpad 22 used at the bottom of most ladder rails 12 is slightly larger than the ladder rail 12, and most such footpads 22 have a range of less than two inches wide and five inches long.

The receptacle structure 20 engages the ladder rail 12 just above the footpad 22. The receptacle structure 20 has a vertical support 24 that extends upwardly from the top surface of the slide pad base 18. The vertical support 24 has two vertical edges. Flexible arms 26 extend from the vertical edges of the vertical support 24. The flexible arms 26 are affixed to the vertical support but not to the slide pad base 18. In a preferred embodiment, the flexible arms 26 are shorter than the vertical support 24 and do not extend down to the slide pad base 18. In such an embodiment, a gap 25 exists under each of the flexible arms 26 that enable the footpad 22 of the stepladder 11 to pass under the flexible arms 26.

A slot 28 is formed in each of the flexible arms 26. A strap 29 extends through the slots 28. The strap 29 has hook and loop fasteners or another tightening mechanism that allows the strap 29 to be pulled taut and secured in place while taut.

The ladder rail 12 is placed between the flexible arms 26 of the receptacle structure 20 so that the footpad 22 passes under the flexible arms 26 and the vertical support 24 lays against the ladder rail 12. Once the ladder rail 12 is in place. The strap 29 is tightened around the ladder rail 12. As the strap 29 tightens, the strap 29 moves the flexible arms 26 and biases the flexible arms 26 against the ladder rail 12. This causes the flexible arms 26 to engage the ladder rail 12 with enough force so that the slide pad device 10 remains affixed to the ladder 11 as the ladder 11 is lifted and moved.

Referring back to FIG. 1, it will be understood that an A-frame ladder 11 is going to be pulled along the ground by lifting the support rails 14 and pulling on the support rails 14 forward. As such, the direction of travel for the ladder 11 will be in the direction of the support rails 14. The slide pad device 10 is attached to the ladder 11 so that the curved edge 19 of the slide pad device 10 faces the support rails 14 of the ladder 11. In this manner, the curved edge 19 will prevent the slide pad device 10 from binding on minor obstacles.

Figure 3:
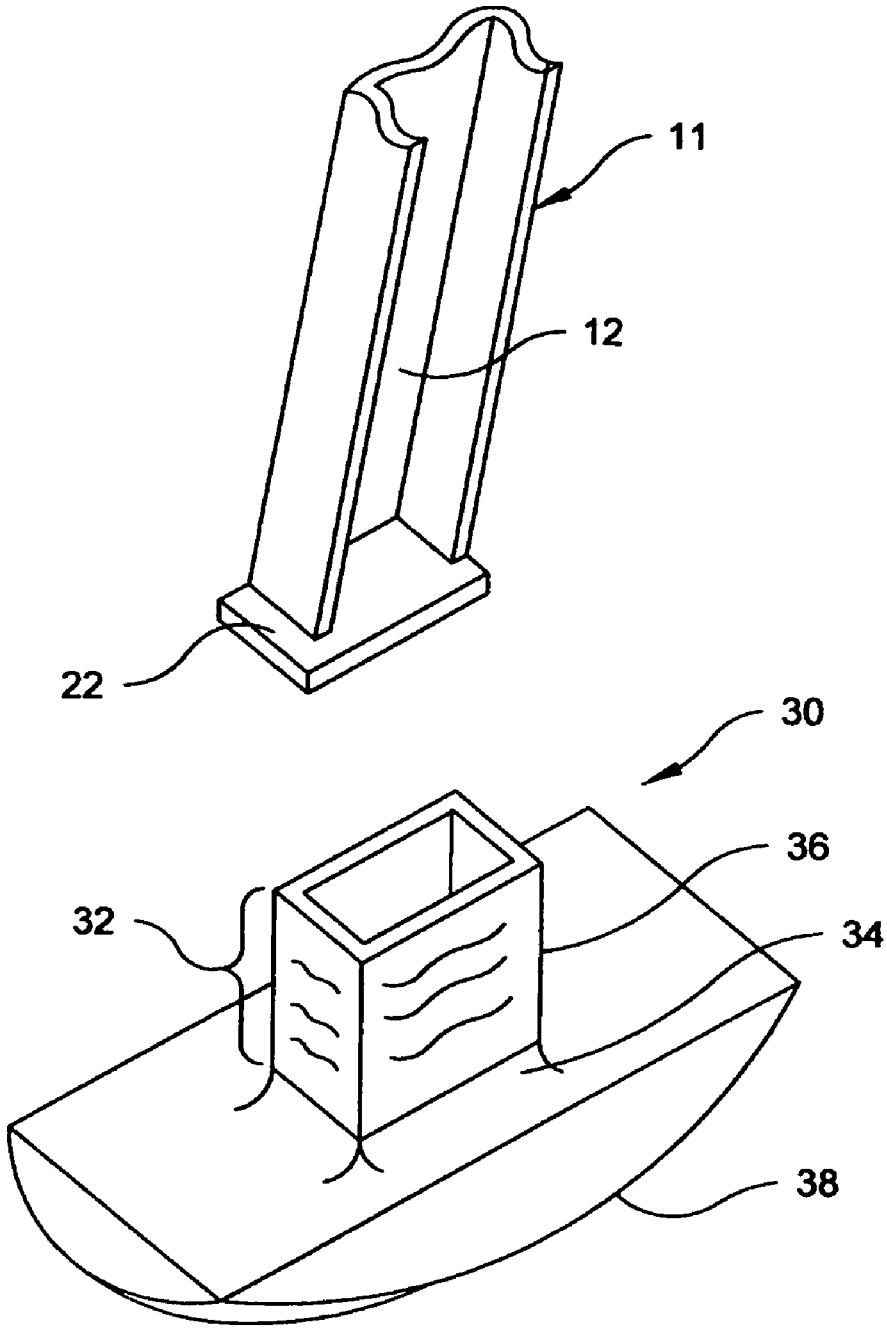
FIG. 3 is a perspective view of a second embodiment of a slide pad device.

Referring now to FIG. 3, the structure of another exemplary embodiment of the slide pad device 30 is shown. In this embodiment, there is an enlarged base 38. The slide pad base 38 has a bottom surface that is curved at all of its peripheral edges. Thus, the slide pad base 38 can move in any direction along the ground without snagging imperfections along the ground. The slide pad base 38 is smooth. The smoothness of the slide pad base 38 causes the slide pad base 38 to have a low coefficient of friction. The curved edge 39 of the slide pad base 38 helps prevent the slide pad base 38 from binding on carpeting or sticking on edges that may be present on the floor.

A receptacle structure 32 extends upwardly from the center of the top surface of the slide pad base 38. The receptacle structure 32 serves two purposes. First, the receptacle structure 32 receives the bottom of a ladder rail 12 and centers the ladder rail 12 on the slide pad base 38. This ensures that the weight borne by the ladder rail 12 is centrally supported by the slide pad base 38. The second purpose of the receptacle structure 32 is to mechanically engage the ladder rail 12, thereby connecting the slide pad base 38 to the ladder rail 12.

The receptacle structure 32 receives the footpad 22 of the stepladder 11. Accordingly, to ensure that the receptacle structure 32 can receive the footpad 22 of most stepladders 11, the receptacle structure 32 has the capacity to receive a footpad 22 at least as big as two inches by five inches.

In the shown embodiment, the receptacle structure 32 contains a peripheral ridge 34. The peripheral ridge 34 extends upwardly from the top surface of the slide pad base 38. When the footpad 22 of a stepladder 11 passes into the receptacle structure 32, the footpad 22 passes into the center of the peripheral ridge 34. The presence of the peripheral ridge 34 confines the footpad 22 of the stepladder 11 and prevents the footpad 22 from moving laterally on the slide pad base 38.

A tubular elastic band 36 extends upwardly from the peripheral ridge 34. The tubular elastic band 36 is either a segment of elastomeric material, such as synthetic rubber, or a segment of cloth woven with elastic threads. In either construction, the tubular elastic band 36 has a compressed size that is narrower than that of the ladder rail 12 and a stretched open size that is larger than that of the footpad 22 on the bottom of the ladder rail 12. Consequently, the tubular elastic band 36 can be stretched open to enable the footpad 22 of a ladder rail 12 to pass through the tubular elastic band 36 and into the peripheral ridge 34. Once the tubular elastic band 36 is released, it will contract around the ladder rail 12, thereby joining the slide pad device 10 to the ladder rail 12.

Figure 4:
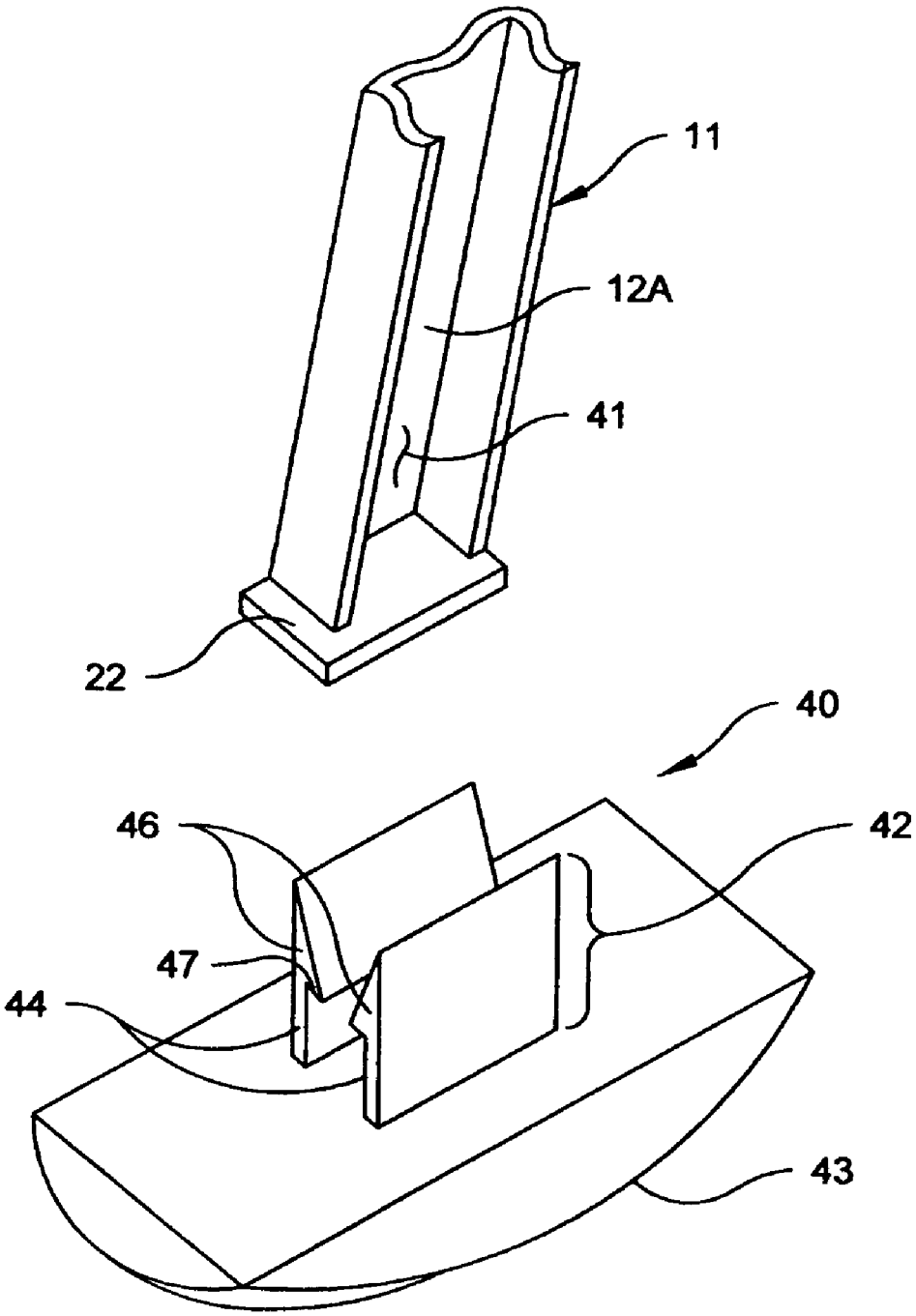
FIG. 4 is a perspective view of a third embodiment of a slide pad device.

The use of a tubular elastic band 36, such as is shown in FIG. 2, is only exemplary and it should be understood that still many other attachment mechanisms can be used to form the receptacle structure of the slide pad device. Two further alternate embodiments are shown in FIG. 3 and FIG. 4, respectively. In each of the two alternate embodiments, the slide pad base is the same as is described in FIG. 1 and FIG. 2. What differs is the manner in which the receptacle structure is formed and how that receptacle structure engages the ladder rail.

Referring to FIG. 4, it can be seen that a typical ladder rail 12A is manufactured from a C-beam section of aluminum, fiberglass or some other stock material. Many manufacturers also use I-beam stock in place of the C-beam stock shown. Regardless of whether a C-beam or I-beam stock is used, a footpad 22 is typically connected to the bottom of the ladder rail 12A. The footpad 22 is typically rectangular. Accordingly, the footpad 22 is rectangular, while the ladder rail 12A immediately above the footpad 22 is not. This causes the ladder rails to have at least one recessed area 26 above the footpad 22. The recessed areas 41 exist for ladders that use either C-beam shaped rails or I-beam shaped rails.

In FIG. 4, the receptacle structure 42 consists of two locking fingers 44 that extend upwardly from the top surface of the slide pad base 43. The two locking fingers 44 are biased inwardly toward each other. On each finger 44 is an angled head 46. The head 46 is sloped and terminates at a lip 47 on the finger 44. As the foot pad 22 of a stepladder is pressed against the locking fingers 44, the foot pad 22 passes between the locking fingers 44 and spreads the locking fingers 44 apart. Once the foot pad 43 of the stepladder passes the lip 47 under the head 46 of the locking fingers 44, the locking fingers 44 spring back into the recessed area(s) 41 of the ladder rail 12A. The presence of the locking fingers 44 on either side of the foot pad 22 prevent the foot pad 22 from moving sideways relative the slide pad device 40. The lip 47 under the heads 47 on the locking fingers 44 engage the foot pad 22 of the ladder rail 12A, thereby mechanically attaching the slide pad device 40 to the stepladder.

As such, it will be understood that provided the ladder rail 12A is wider than the minimum space between the locking fingers 44 and narrower than the maximum space between the locking fingers 44, the slide pad device 40 will attach to any step ladder having C-beam or I-beam shaped rails.

Figure 5:
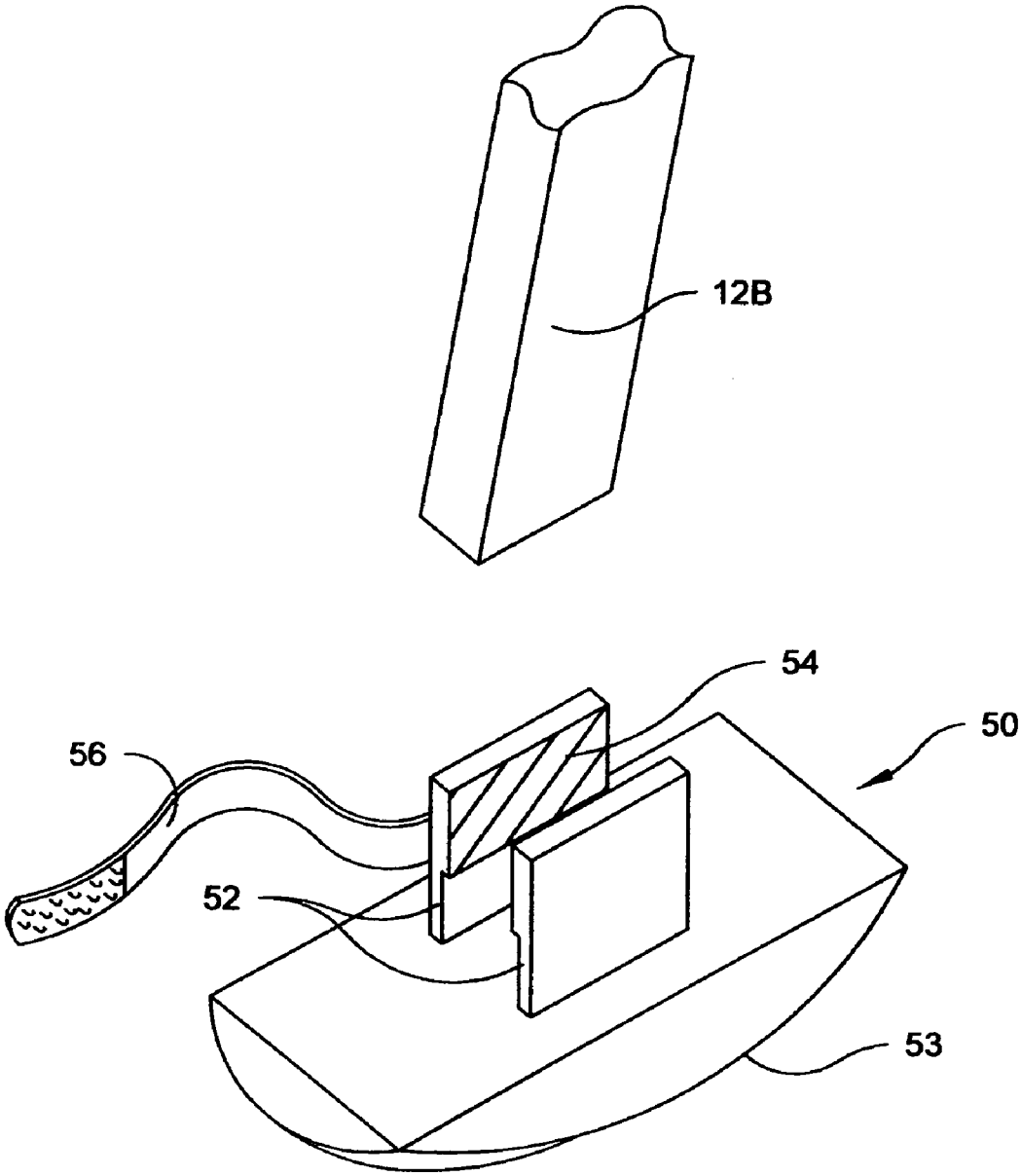
FIG. 5 is a perspective view of a fourth embodiment of a slide pad device.

Some wooden stepladders and small plastic stepladders have rectangular shaped ladder rails. In FIG. 5, an embodiment of a slide pad device 50 is shown for use with such a configuration. In the shown embodiment, two flexible fingers 52 extend upwardly from the top surface of the slide pad base 53. Rubber friction pads 54 are affixed to the surface of the fingers 52 that face each other. A strap 56 extends from at least one of the fingers 52. The strap 56 can have hook and loop material, such as Velcro, on its external surfaces.

To utilize the slide pad device 50, the foot pad 22 of a stepladder is placed between the flexible fingers 52. The strap 56 is then wrapped around the ladder rail 12B and is used to bias the rubber friction pads 54 against the sides of the ladder rail 12B. The friction created by the contact of the friction pads 54 and the ladder rail 12B connects the slide pad device 50 to the stepladder and prevents the slide pad device 50 from falling away from the stepladder.

In the embodiments shown, there are illustrated three different types of receptacles structures that can be used to interconnect the slide pad devices with the ladder rails. It should be understood that the use of such embodiments are exemplary and there are many different ways that a slide pad device can be mechanically attached to the rails of a ladder. For example, a slide pad device can be attached to the ladder rails with mechanical fasteners, such as screws. Alternately, adhesive fasteners, such as double sided tape can also be used. In any selected embodiment, the slide pad device is to receive the ladder rail in the center of its structure and engage the ladder rail so that the slide pad device does not separate from the ladder rail when the ladder is lifted or otherwise moved from point-to-point.

All embodiments of the present invention slide pad device share the same general shape for the slide pad base. It is only the receptacle structure that varies between embodiments. The slide pad base has a smooth underside so as to present a low coefficient of friction when sliding along the floor. The slide pad base can be molded from a smooth plastic, such as nylon, Teflon(Tm) or Kevlar(Tm) or Tyvek(Tm). Such materials are very good for indoor use, where the slide pad device is being dragged across carpeting or hardwood flooring. In outdoor applications, where the slide pad device is to be pulled across concrete and pavement, plastic material tends to easily scratch and loose smoothness. For such outdoor applications, it is preferred that the slide pad base be made of a polished metal, such as stainless steel. Such material will slide across pavement, concrete, stones and the like with little loss of polish, thereby maintaining its low coefficient of friction.

It will be understood that the embodiments of the present invention that are described and illustrated herein are merely exemplary and a person skilled in the art can make many variations to the embodiment shown without departing from the scope of the present invention. For example, the slide pad base of the device can be made into many different configurations other than the rectangular configuration shown. Furthermore, as was previously explained, the receptacle structure used to connect the slide pad base to a ladder can be configured in many different ways. All such variations, modifications and alternate embodiments are intended to be included within the scope of the present invention as defined by the appended claims.

What is claimed is:

1. An assembly comprising:

a ladder having at least two ladder rails that support the ladder in a standing position; and slide pads attached to at least some of said ladder rails so that said slide pads are disposed under said at least some of said ladder rails when said ladder is in said standing position, each of said slide pads having a base, a vertical support that extends upwardly from said base, and flexible arms that extends from vertical support, wherein said vertical support and said flexible arms form a receptacle structure that receives and engages one of said ladder rails of said ladder.

2. The assembly according to claim 1, further including a strap attached to said flexible arms for biasing said flexible arms toward each other.

3. The assembly according to claim 1, wherein said base of said slide pad has at least one curved edge.

4. The assembly according to claim 1, whereon said base of said slide pad is metal.

5. An assembly comprising:

a ladder having at least two ladder rails that support the ladder in a standing position;

slide pads attached to at least some of said ladder rails so that said slide pads are disposed under said at least some of said ladder rails when said ladder is in said standing position, each of said slide pads having a base and a receptacle structure that extends upwardly from said base, wherein said receptacle structure includes a tubular elastic band that is adapted to surround a portion of one of said ladder rails, thereby enabling said receptacle structure to receive and engage a ladder rail.

6. The assembly according to claim 5, wherein a peripheral ridge extends upwardly from said slide pad base and said tubular elastic band extends upwardly from said peripheral ridge.

7. An assembly comprising:

a ladder having at least two ladder rails that support the ladder in a standing position; and slide pads attached to at least some of said ladder rails so that said slide pads are disposed under said at least some of said ladder rails when said ladder is in said standing position, each of said slide pads having a base and fingers that extend upwardly from said base, wherein said fingers form a receptacle structure that receives and engages one of said ladder rails of said ladder and there is at least one strap for biasing said fingers toward each other.

8. The assembly according to claim 7, further including sloped locking heads on said fingers.

* * * * *